US011412580B2

(12) United States Patent
Li et al.

(10) Patent No.: US 11,412,580 B2
(45) Date of Patent: Aug. 9, 2022

(54) HEATING DEVICE FOR HEATING CIGARETTE

(71) Applicant: Shenzhen First Union Technology Co., Ltd., Shenzhen (CN)

(72) Inventors: Yonghai Li, Shenzhen (CN); Zhongli Xu, Shenzhen (CN); Hongbin Chen, Shenzhen (CN); Shengjia Song, Shenzhen (CN); Yuqin Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 739 days.

(21) Appl. No.: 15/647,285

(22) Filed: Jul. 12, 2017

(65) Prior Publication Data

US 2017/0303598 A1 Oct. 26, 2017

(30) Foreign Application Priority Data

Jul. 23, 2016 (CN) ..... 201620778266.3

(51) Int. Cl.

| | |
|---|---|
| ***H05B 3/04*** | (2006.01) |
| ***H05B 3/22*** | (2006.01) |
| ***H05B 3/44*** | (2006.01) |
| ***A24F 40/46*** | (2020.01) |
| ***A24F 40/20*** | (2020.01) |

(52) U.S. Cl.

CPC ..... *H05B 3/04* (2013.01); *A24F 40/46* (2020.01); *H05B 3/22* (2013.01); *H05B 3/44* (2013.01); *A24F 40/20* (2020.01); *H05B 2203/021* (2013.01); *H05B 2203/022* (2013.01)

(58) Field of Classification Search

CPC ..... A24F 47/008; A24F 40/46; A24C 5/3406; A63F 2009/0063; B43K 29/00

USPC ..... 219/265

See application file for complete search history.

(56) References Cited

U.S. PATENT DOCUMENTS 2,983,407 A * 5/1961 Franchino ..... A24F 15/04 221/147
5,564,442 A * 10/1996 MacDonald ..... A24F 40/40 131/194
5,934,289 A * 8/1999 Watkins ..... A24F 40/53 131/328

(Continued)

FOREIGN PATENT DOCUMENTS

GB 2534214 A * 7/2016 ..... A24F 40/46

*Primary Examiner* — Ibrahime A Abraham
*Assistant Examiner* — Spencer H. Kirkwood
(74) *Attorney, Agent, or Firm* — Cheng-Ju Chiang

(57) ABSTRACT

The present disclosure relates to a heating device for heating a cigarette The heating device includes a housing, a heating chamber arranged in the housing, at least one heating element, a control component, and a power supply. The housing defines an opening for insertion of the cigarette. The heating chamber is configured for partly receiving the cigarette. The at least one heating element is configured for heating the cigarette. The heating element is movably arranged in the heating chamber. The control component is configured for driving the at least one heating element to move, so that the at least one heating element abuts against an outer surface of the cigarette. The power supply is configured for supplying the at least one heating element power.

13 Claims, 5 Drawing Sheets

(56) References Cited

U.S. PATENT DOCUMENTS

| | | | | |
|---|---|---|---|---|
| 6,053,176 | A * | 4/2000 | Adams | A24F 40/60 131/329 |
| 6,719,473 | B1 * | 4/2004 | Kao | B43K 24/084 362/118 |
| 9,687,027 | B2 * | 6/2017 | Poston | A61M 11/047 |
| 2002/0005207 | A1 * | 1/2002 | Wrenn | A24C 5/478 131/194 |
| 2016/0007648 | A1 * | 1/2016 | Sutton | A24F 7/02 131/187 |
| 2017/0347706 | A1 * | 12/2017 | Aoun | F22B 1/284 |
| 2018/0104425 | A1 * | 4/2018 | Hogwood | A24F 40/40 |
| 2018/0279678 | A1 * | 10/2018 | Hepworth | A24D 1/002 |
| 2018/0325174 | A1 * | 11/2018 | Sutton | A24F 40/42 |
| 2020/0390154 | A1 * | 12/2020 | Bouchuiguir | A24F 40/60 |

* cited by examiner

HEATING DEVICE FOR HEATING CIGARETTE

TECHNICAL FIELD

The present invention relates to a heating device for heating a cigarette.

BACKGROUND ART

A typical heating device for heating a cigarette includes a heating chamber formed by at least one heating piece. In use, a cigarette is inserted into the heating chamber. For easy insertion, an inner diameter of the heating chamber is usually larger than that of the cigarette. However, in this case, the cigarette is not in tight contact with the heating pieces. Accordingly, a thermal efficiency of the heating device is not very high.

What is needed, therefore, is a heating device, which can overcome the above shortcomings.

SUMMARY

The present disclosure relates to a heating device for heating a cigarette. The heating device includes a housing, a heating chamber arranged in the housing, at least one heating element, a control component, and a power supply. The housing defines an opening for insertion of the cigarette. The heating chamber is configured for partly receiving the cigarette. The at least one heating element is configured for heating the cigarette. The heating element is movably arranged in the heating chamber. The control component is configured for driving the at least one heating element to move, so that the at least one heating element abuts against an outer surface of the cigarette. The power supply is configured for supplying the at least one heating element power.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
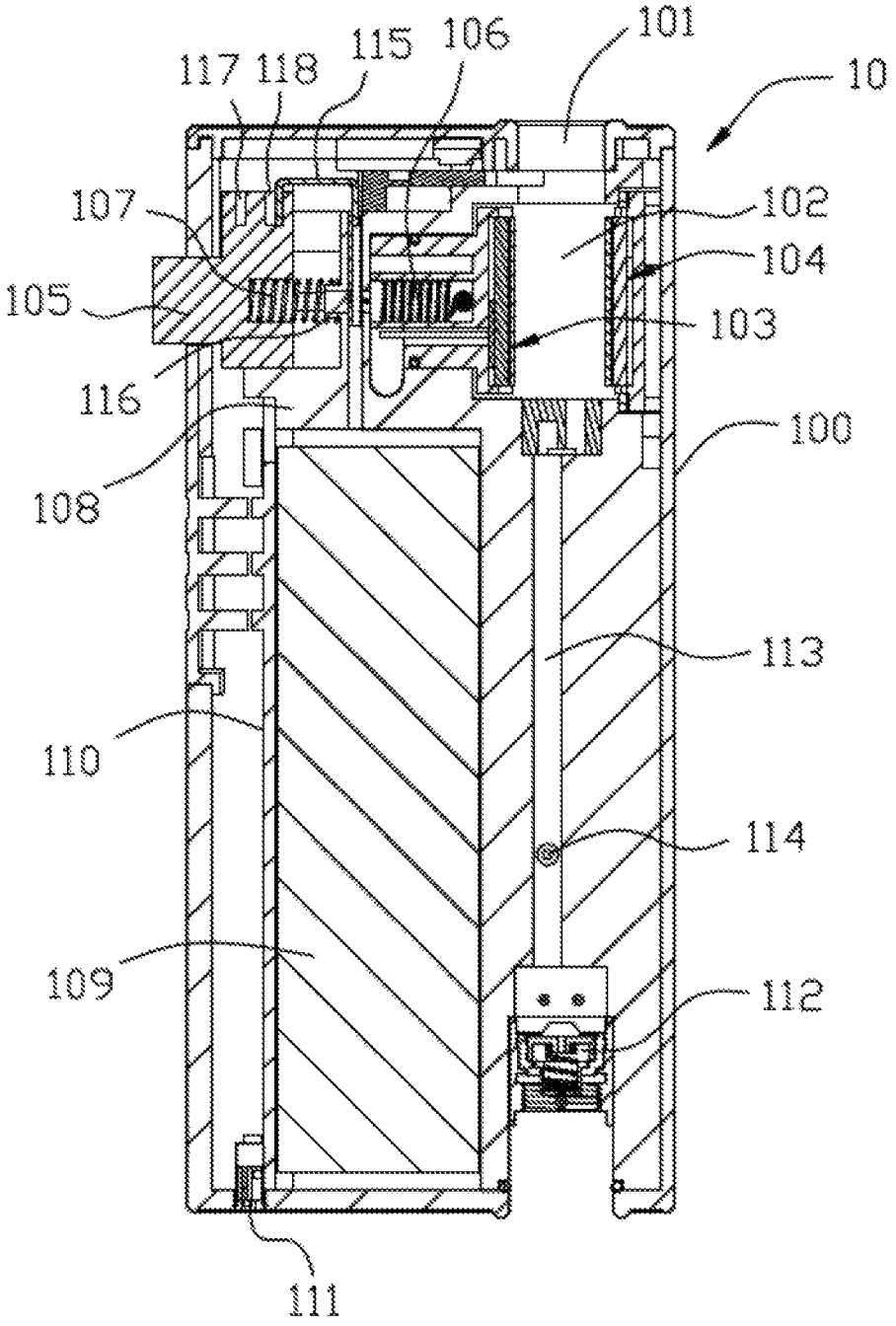
FIG. 1 is a cross-sectional view of a heating device, including a heating element, when the heating element is in an original position.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, a heating device 10 includes a housing 100, a main frame 108 in the housing 100, and heating elements 103, 104 arranged on the main bracket 108, a power supply 109, a control circuit board 110, and a control component. The control component is configured (i.e., structured and arranged) for controlling movement of the heating elements 103 or 104.

The housing 100 defines an opening 101 on top of the housing for insertion of a cigarette 20. The housing 100 defines a heating chamber 102. The cigarette 20 can be inserted into the heating chamber 102 via the opening 101. The heating element 103 is movably arranged in the heating chamber 102, so that a distance between the heating elements 103 and 104 is adjustable. When the heating element 103 is in an original position, the cigarette 20 can be inserted into the heating chamber 102 easily. When the heating element 103 is moved right, the cigarette 20 is compressed, and the heating elements 103, 104 tightly abut against an outer surface of the cigarette 20. In this way, the heating elements 103, 104 heat the cigarette 20 more efficiently.

The power supply 109 is configured for feeding the heating elements 103, 104 power. The power supply 109 may be a lithium battery. The power supply 109 is connected to the hating elements 103, 104 via the control circuit board 110. The control circuit board 110 includes a charging port 111 for recharging the heating device 10.

In the present embodiment, the control component is a button 105 arranged on the housing 100. The button 105 is configured for pushing the heating element 103 to move to abut tightly against the cigarette 20, when the button is pressed.

The heating device 10 further includes a first spring 106 connected to the heating element 103 and a positioning rod 116 arranged in the main frame 108. One end of the first spring 106 is connected to the heating element 103, the other end is fixed with the positioning rod 116. When the button 105 is first pressed, the first spring 106 is stretched; when the button 105 is pressed again and released, the heating element 103 restores to its original position upon an elastic force of the first spring 106. The heating device 10 further includes a second spring 107 abutting against the button 105. The second spring 107 is configured for ejecting the button 105 when the button 105 is pressed again.

The heating device 10 further includes a positioning device configured for keeping the button 105 and the heating element 103 in place. When the button 105 is pressed, the positioning device keeps the heating element in tight contact with the outer surface of the cigarette 20.

Quite usefully, the positioning device includes a hook 115 engaged with the main frame 108. The button 105 includes a first position 118 and a second position 117 both configured for positioning the hook 115. The first position 118 and the second position 117 are in communication with each other via a sliding groove, which forms a closed loop (described in detail later). When the button 105 is pressed repeatedly, the hook 115 is capable of switching between the first position 118 and the second position 117.

Referring to FIG. 1, when not working, the button 105 is not pressed, the hook 115 is in the first position 118, the heating element 103 is not pushed by the button 105, and the heating element 103 is in the original position.

Figure 2:
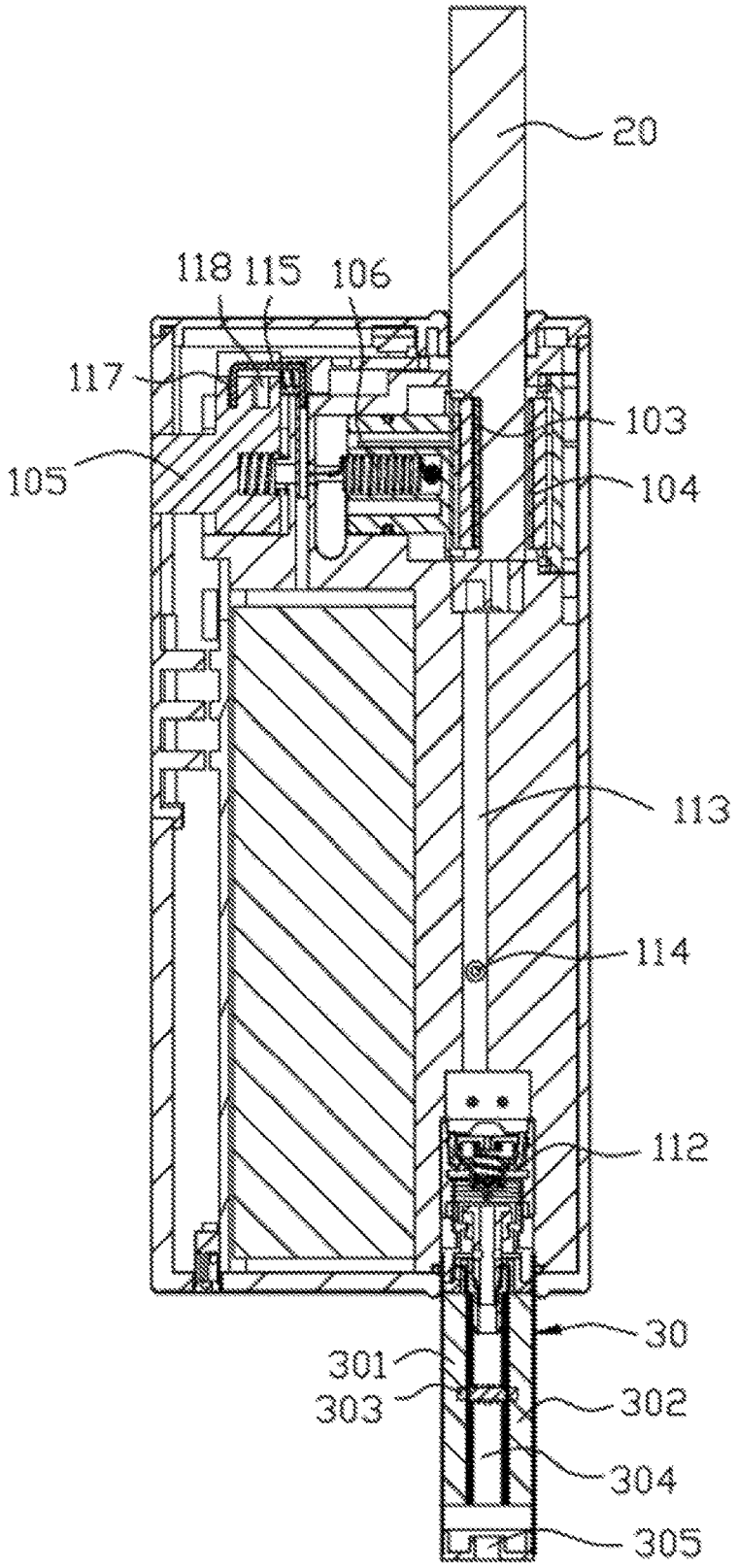
FIG. 2 is a cross-sectional view of the heating device of FIG. 1 coupled with a cigarette, when the heating element is pushed to abut against the cigarette.

Referring to FIG. 2, when the user of the heating device 10 smokes, the cigarette 20 is inserted into the heating chamber 102, and the button 105 is pressed. The button 105 pushes the heating element 103 to move right, and to compress the cigarette 20, and the hook 115 slides to the second position 117. With the hook in the second position, even the button 105 was released, the hook 115 can still keep the heating element 103 in the position compressing the cigarette 20.

Quite usefully, the button 105 and a switch of the heating element 103 are linkage-operated. For example, a Hall switch is provided on the control circuit board 110. When the button 105 is pressed, the Hall switch is activated, so that the heating elements 103, 104 work simultaneous. Accordingly, the button 105 achieves the function of clamping the cigarette 20 and activating the heating device 10.

Figure 3:
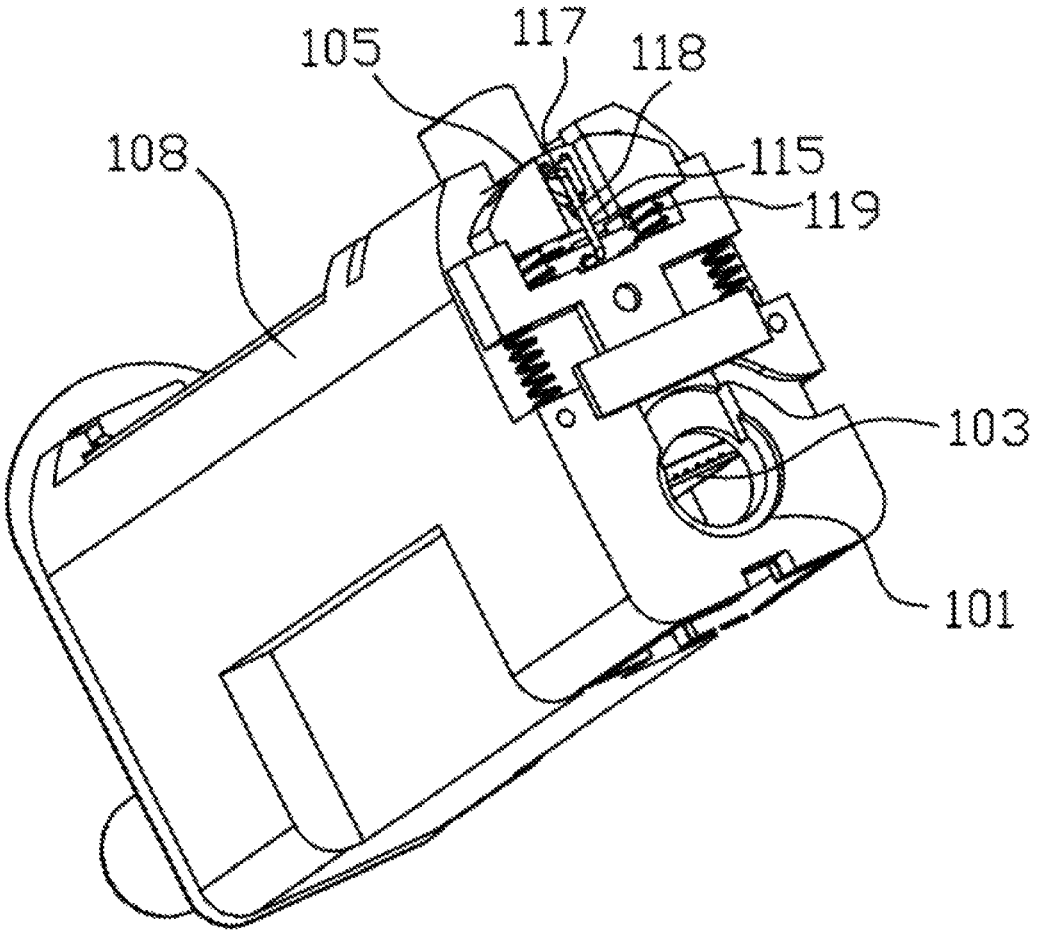
FIG. 3 is a perspective view of the heating device of FIG. 1, showing an engagement between a button and a positioning device.
Figure 4:
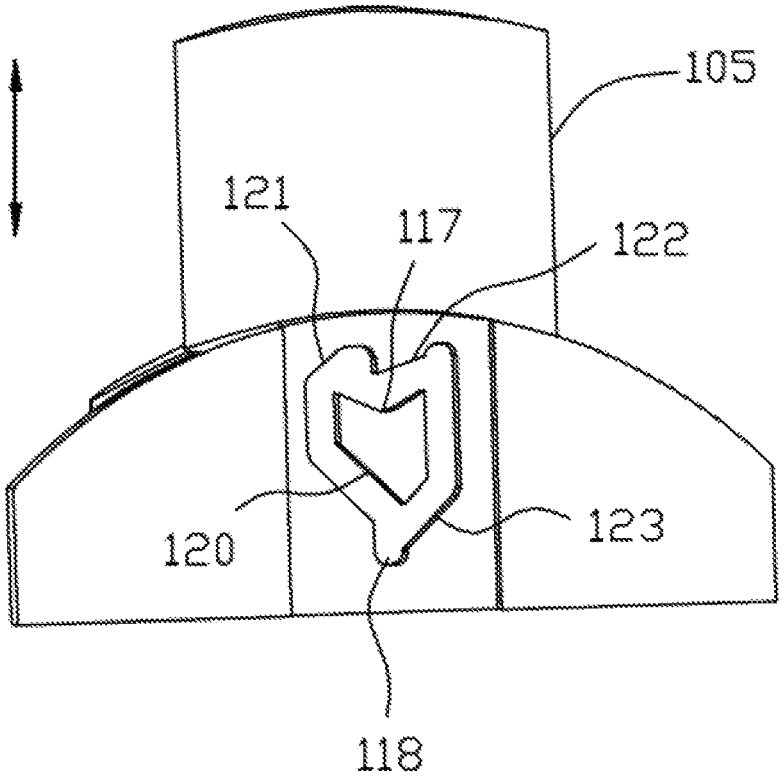
FIG. 4 is a cross-sectional view showing a first position and a second position where a hook is engaged with the button.

Referring to FIGS. 3-4, the main frame 108 includes two horizontal guiding rods 119, and the button 105 moves back and forth along the horizontal guiding rods 119. The hook 115 is switched between the first position 118 and the second position 117 along the closed-loop sliding groove.

Referring to FIG. 4, the first position 118 and the second position 117 are arranged along a line parallel to a central axial of the button 105. When the hook 115 is in the first position 118 (an original state) and the button 105 is pressed by the user, the hook 115 slides up along an inclined surface 120, then along an inclined surface 121 towards a center. At the same time, the button 105 pushes the heating element 103 to move. When the button 105 is released, the hook 115 is engaged in the second position 117. In this state, the button 105 and the heating element 103 are kept in this position.

When the user stop smoking, the button 105 is pressed again and released, the hook 115 slides along an inclined surface 122, and then along an inclined surface 123 to the first position 118. In this state, the button 105 and the heating element 103 return to their original positions.

Figure 5:
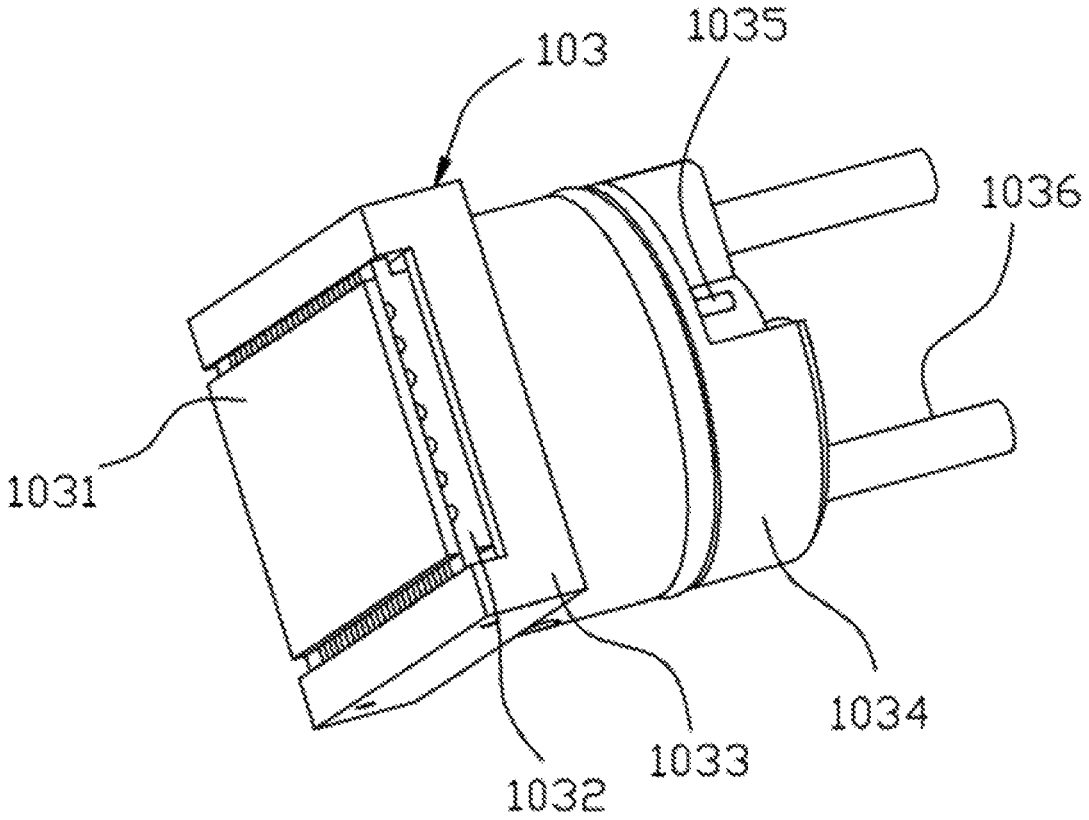
FIG. 5 is a perspective view of a heating element.

Referring to FIGS. 1 and 5, quite usefully, the heating element 103 is movable, and the heating element 104 is fixed. Each heating element includes a holder 1033, a heating piece 1031, and a heat insulation layer 1032 sandwiched between heating piece 1031 and the holder 1033. In the present embodiment, the heating elements 103, 104 are parallel to each other, and each of the heating elements 103, 104 includes a flat surface for contacting with the cigarette 20. It is to be understood that a contact surface of the heating elements 103, 104 may be arc-shaped.

The holder 1033 includes a cylindrical shaft part 1034. The heating element 103 can slide smoothly in the frame 108 via the shaft part 1034. The holder 1033 further includes two pushing rods 1036 at an end. The pushing rods 1036 are coupled with the button 105, so that the button 105 can drive the heating element 103 to move via the pushing rods 1036. The shaft part 1034 is hollow, and defines a chamber.

It is noteworthy that in other embodiments, both of the heating elements 103, 104 may be movable.

Referring to FIGS. 1-2, the heating device 10 further includes an atomizer 30. The atomizer 30 is in communication with the heating chamber 102 via the air passage 113. An electrical connection part 112 is provided at a bottom of the air passage 113. The atomizer 30 is detachably connected to the electrical connection part 112. The electrical connection part 112 is configured for connecting to a power supply.

The atomizer 30 includes a liquid chamber 301 configured for storing tobacco liquid and an atomizing unit 303 configured for atomization. A medium 302 is provided in the liquid chamber 301, and is configured for absorbing tobacco liquid. The medium 302 may be cellucotton. The atomizing unit 303 includes a liquid conducting body and a heating wire. The atomizing unit 303 is configured for absorbing tobacco liquid from the liquid chamber 301, and atomizing the tobacco liquid to form aerosol. The atomizing unit 303 is in a middle of the atomizing chamber 304, and an air inlet 305 defined in a bottom part. When the user smokes, the aerosol passes through the air passage 113 and enters the heating chamber 102. The aerosol is then mixed with another aerosol, which is formed by heating the cigarette 20, thus improving user experience. In addition, when no cigarette is inserted into the heating chamber 102, the atomizer 30 may work independently. In this case, the opening 101 functions as an air inlet, a bottom part of the atomizer 30 is used as a mouthpiece, and the air inlet 305 serves as an air outlet.

A sensing air inlet 114 is provided in the air passage 113, and an air flow sensor (not shown) is provided in the sensing air inlet 114. The air flow sensor is configured for activating the atomizing unit 303 when an amount of air in the air passage 113 changes. That is, the atomizer 30 starts working when the user smokes.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heating device for heating a cigarette, comprising:

a housing defining an opening for insertion of the cigarette;

a heating chamber arranged in the housing, the heating chamber being configured for receiving a part of the cigarette and being completely occupied by the part of the cigarette;

at least two heating elements configured for heating the cigarette, a first heating element out of the at least two heating elements being movably arranged in the heating chamber along a preset direction from a sidewall of the heating chamber toward an opposite sidewall of the heating chamber, a second heating element out of the at least two heating elements being positioned at the opposite sidewall of the heating chamber;

a control component configured for driving the first heating element to move along the preset direction toward the second heating element, so that both of the first heating element and the second heating element abut against an outer surface of the cigarette to clamp the part of the cigarette together to compress the part of the cigarette, and the first heating element further moves to a location where a first distance between the location and the opposite sidewall of the heating chamber is smaller than a second distance between the sidewall of the heating chamber and the opposite sidewall of the heating chamber; and a power supply configured for supplying the at least two heating elements power.

2. The heating device according to claim 1, wherein the control component comprises a button arranged on the housing, the button is configured for pushing the first heating element to abut against the outer surface of the cigarette when the button is pressed.

3. The heating device according to claim 2, further comprising a first spring connected to the first heating element, wherein the first spring is configured for driving the first heating element to restore to its original position after the button is released.

4. The heating device according to claim 2, further comprising a second spring abutting against the button, wherein the second spring is configured for ejecting the button when the button is pressed again.

5. The heating device according to claim 2, further comprising a positioning device, wherein the positioning device is configured for keeping the button and the first heating element in place, and keeping the first heating element in the location and in tight contact with the outer surface of the cigarette when the button is pressed.

6. The heating device according to claim 5, wherein the positioning device comprises a hook, the button comprises a first position and a second position both configured for positioning the hook, the hook is switchable between the first position and the second position when the button is pressed repeatedly.

7. The heating device according to claim 2, wherein the button and the first heating element are linkage-operated.

8. The heating device according to claim 1, wherein each of the first heating element and the second heating element comprises a holder, a heating piece, and a heat insulation layer sandwiched between the heating piece and the holder, and the two heating pieces of the first and second heating elements are arranged in a parallel manner.

9. The heating device according to claim 1, further comprising an atomizer, wherein the heating device defines an air passage, the atomizer is in communication with the heating chamber via the air passage, the atomizer comprises a liquid chamber and an atomizing unit, the liquid chamber is configured for containing tobacco liquid, the atomizing unit is configured for atomizing the tobacco liquid to form aerosol, and the aerosol is capable of flowing into the heating chamber via the air passage.

10. The heating device according to claim 9, wherein the atomizer is detachably connected to an electrical connection part provided at an end of the air passage.

11. The heating device according to claim 9, wherein air flows from the opening toward the atomizer via the heating chamber and the air passage sequentially in order to supply the air to the atomizer for generating the aerosol when the cigarette is not inserted in the opening, and the aerosol is inhaled from an end of the atomizer opposite to the air passage.

12. A heating device for heating a cigarette having a central axis, comprising:

a housing defining an opening for insertion of the cigarette;

a heating chamber arranged in the housing, the heating chamber being configured for partly receiving the cigarette;

at least one heating element configured for heating the cigarette, the heating element being movably arranged in the heating chamber along a preset direction from beyond an outer surface of the cigarette toward the central axis of the cigarette;

a control component configured for driving the at least one heating element to move along the preset direction, so that the at least one heating element abuts against the outer surface of the cigarette;

a power supply configured for supplying the at least one heating element power; and an atomizer, wherein the heating device defines an air passage, the atomizer is in communication with the heating chamber via the air passage, the atomizer comprises a liquid chamber and an atomizing unit, the liquid chamber is configured for containing tobacco liquid, the atomizing unit is configured for atomizing the tobacco liquid to form an aerosol, and the aerosol is capable of flowing into the heating chamber via the air passage;

wherein air flows from the opening toward the atomizer via the heating chamber and the air passage sequentially in order to supply the air to the atomizer for generating the aerosol when the cigarette is not inserted in the opening, and the aerosol is inhaled from an end of the atomizer opposite to the air passage.

13. The heating device according to claim 1, wherein the opening has a diameter equal to the second distance.

* * * * *